US009112311B2

(12) United States Patent
Asai

(10) Patent No.: US 9,112,311 B2
(45) Date of Patent: Aug. 18, 2015

(54) CONNECTOR

(71) Applicant: SMK Corporation, Tokyo (JP)

(72) Inventor: Kiyoshi Asai, Yokohama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 14/162,746

(22) Filed: Jan. 24, 2014

(65) Prior Publication Data

US 2015/0004836 A1 Jan. 1, 2015

(30) Foreign Application Priority Data

Jun. 27, 2013 (JP) ..... 2013-134828

(51) Int. Cl.

| | |
|---|---|
| ***H01R 12/00*** | (2006.01) |
| ***H01R 13/658*** | (2011.01) |
| ***H01R 12/71*** | (2011.01) |
| ***H01R 13/6581*** | (2011.01) |

(52) U.S. Cl.

CPC ..... *H01R 13/658* (2013.01); *H01R 12/716* (2013.01); *H01R 13/6581* (2013.01)

(58) Field of Classification Search

CPC .... H01R 23/725; H01R 12/79; H01R 12/592; H01R 23/662; H01R 23/6875; H01R 13/658; H01R 23/7073

USPC ..... 439/74, 492–495, 497, 607.35, 607.4, 439/607.41, 607.47, 660

See application file for complete search history.

(56) References Cited

U.S. PATENT DOCUMENTS

| | | | | |
|---|---|---|---|---|
| 6,923,659 | B2 * | 8/2005 | Zhang et al. | 439/74 |
| 7,052,286 | B2 * | 5/2006 | Zhang | 439/74 |
| 7,070,423 | B2 * | 7/2006 | Zhang et al. | 439/74 |
| 7,144,277 | B2 * | 12/2006 | Pan et al. | 439/660 |
| 7,585,185 | B2 * | 9/2009 | Obikane | 439/607.01 |
| 7,815,467 | B2 * | 10/2010 | Tsuchida et al. | 439/607.09 |
| 7,931,493 | B2 * | 4/2011 | Cheng | 439/497 |
| 8,408,931 | B2 * | 4/2013 | Sato et al. | 439/357 |
| 8,485,832 | B2 * | 7/2013 | Mashiyama et al. | 439/74 |
| 8,550,849 | B2 * | 10/2013 | Yamaji | 439/607.41 |
| 8,602,812 | B2 * | 12/2013 | Ohsaka | 439/497 |

(Continued)

FOREIGN PATENT DOCUMENTS

| | | |
|---|---|---|
| JP | 2011-119119 A | 6/2011 |
| JP | 2011-216220 A | 10/2011 |

(Continued)

OTHER PUBLICATIONS

Notice of Office Action for Japanese Patent Application No. 2013-134828, issued by the Japan Patent Office on Jan. 29, 2015.

*Primary Examiner* — Thanh Tam Le

(57) ABSTRACT

A connector capable of achieving a height reduction thereof; dealing with connecting a large number of wires; and easily obtaining a shielding effect against external and internal noises is provided. A receptacle used for the connector includes: a receptacle housing of a plate shape having a width direction, a depth direction, and a thickness direction; a plurality of contacts disposed on respective side surfaces of the receptacle housing in the depth direction so as to be parallel to each other in the width direction; and a conductive shield member having an attachment part. The receptacle housing is provided with a plurality of grooves having the same shape into which the plurality of contacts and the attachment part can be inserted.

5 Claims, 11 Drawing Sheets

(56) References Cited

U.S. PATENT DOCUMENTS

| | | | | |
|---|---|---|---|---|
| 8,840,407 | B2 * | 9/2014 | Nose et al. | 439/74 |
| 2011/0136379 | A1 | 6/2011 | Midorikawa et al. | |

FOREIGN PATENT DOCUMENTS

| | | | |
|---|---|---|---|
| JP | 2012-252864 | A | 12/2012 |
| JP | 2013-41771 | A | 2/2013 |

* cited by examiner

CONNECTOR

CROSS REFERENCE TO RELATED APPLICATION

The contents of the following Japanese patent application are incorporated herein by reference, NO. 2013-134828 filed on Jun. 27, 2013.

FIELD

The present invention relates to a connector having a shield structure.

BACKGROUND

There is conventionally known a connector such that a plug and a socket are provided on two substrates, respectively, in order to electrically connect those substrates and the plug is inserted into the socket while bringing those substrates closer to each other to achieve electrical connection between printed wires on the two substrates (see Patent Literature 1, for example).

There is also known a connector to be fixed on a substrate and to which a plate cable is attached (see Patent Literature 2, for example). The connector of Patent Literature 2 includes a hollow housing having an upper surface portion, a first side portion, and a second side portion. The housing includes: an upper surface opening allowing the plate cable to pass therethrough; a first retaining part for interfering with an end face of a wing portion of a reinforcing plate in the plate cable moving toward the second side portion; and a second retaining part for interfering with the reinforcing plate moving toward the upper surface portion.

CITATION LIST

Patent Literature

Patent Literature 1: Japanese Patent Application Publication No: 2013-41771

Patent Literature 2: Japanese Patent Application Publication No: 2012-252864

SUMMARY

Technical Problem

What is needed in Patent Literature 1 is a reduction in the height of the connector. Patent Literature 2 also has problems such that: the connector cannot deal with connecting a large number of wires; accuracy of alignment therebetween when the plate cable is attached to the connector on the substrate cannot be improved; the cost of the plate cable having the reinforcing plate cannot be reduced; and it has no shielding effect against external and internal noises.

The present invention has been made in order to solve such problems. It is an object of the present invention to provide a connector capable of: being used for substrate-to-substrate connection, substrate-to-FPC connection, or the like; achieving a height reduction; dealing with connecting a large number of wires; improving alignment accuracy when electrically connecting a plug to a receptacle; achieving a cost reduction; and easily obtaining a shielding effect against external and internal noises.

Solution to Problem

A receptacle used for a connector according to the present invention includes: a receptacle housing of a plate shape having a width direction, a depth direction, and a thickness direction; a plurality of contacts disposed on respective side surfaces of the receptacle housing in the depth direction so as to be parallel to each other in the width direction; and a conductive shield member having an attachment part, wherein the receptacle housing is provided with a plurality of grooves having the same shape into which the plurality of contacts and the attachment part can be inserted.

According to this receptacle, a height reduction in the connector can be achieved; it is possible to deal with connecting a large number of wires; alignment accuracy upon the connector fitting can be improved; a cost reduction can be achieved; and a shielding effect against external and internal noises can be easily obtained.

In the receptacle, the shield member may have a plate shape extending in the width direction and may include at least one attachment part for each of ends thereof.

A connector according to the present invention includes one of the above-described receptacles and a plug, the plug including: a plug housing of a plate shape having a width direction, a depth direction, and a thickness direction; contacts disposed on respective side surfaces of the plug housing in the depth direction so as to be parallel to each other in the width direction; a reinforcing plate formed in an elongate plate shape and disposed in the width direction at a center of the plug housing in the depth direction; and locking parts provided at positions projected from opposite side surfaces of the plug housing in the width direction. The connector includes hold-down parts provided at positions projected from respective side surfaces of the receptacle housing in the width direction. Each of the hold-down parts has: an insertion opening and an internal space into which the locking part of the plug can be inserted in the depth direction; and a holding part for holding the locking part at a predetermined position. The insertion opening is in communication with the internal space in the depth direction of the housing.

According to this connector, a height reduction can be achieved; it is possible to deal with connecting a large number of wires; alignment accuracy between the plug and the receptacle when electrically connecting one of them to the other can be improved; and a cost reduction can be achieved. Furthermore, a shielding effect against external and internal noises can be easily obtained.

In the connector, the reinforcing plate may be conductive.

In the connector, each of the contacts in the receptacle may include: a contact portion to be in contact with corresponding one of the contacts in the plug; an elastic deformable portion; and a fixed portion, and the attachment part of the shield member may include a contact portion, an elastic deformable portion, and a fixed portion having respective shapes similar to those of the contact.

Advantageous Effects of Invention

According to the present invention, a height reduction in the connector can be achieved; it is possible to deal with connecting a large number of wires; alignment accuracy when electrically connecting the plug to the receptacle can be improved; a cost reduction can be achieved; and a shielding effect against external and internal noises can be easily obtained.

DESCRIPTION OF EMBODIMENTS

A connector according to an embodiment of the present invention will now be described below with reference to the drawings.

Figure 1A:
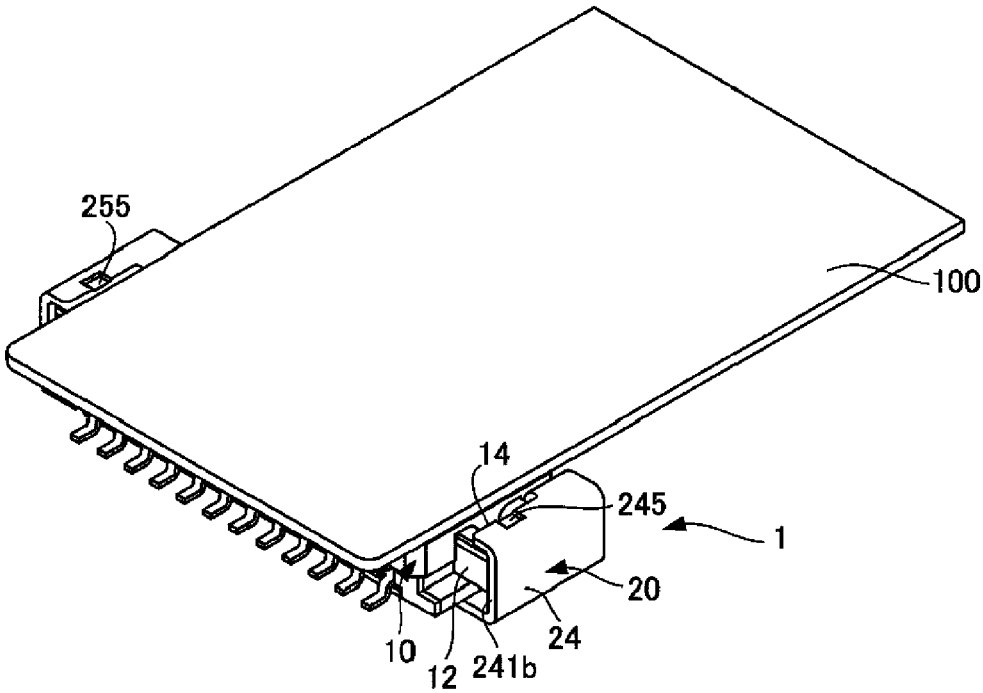
FIG. 1A is a perspective view, as viewed from a plug assembled body side, illustrating a connector according to an embodiment of the present invention in a state where a plug has been fitted into a receptacle.
Figure 1B:
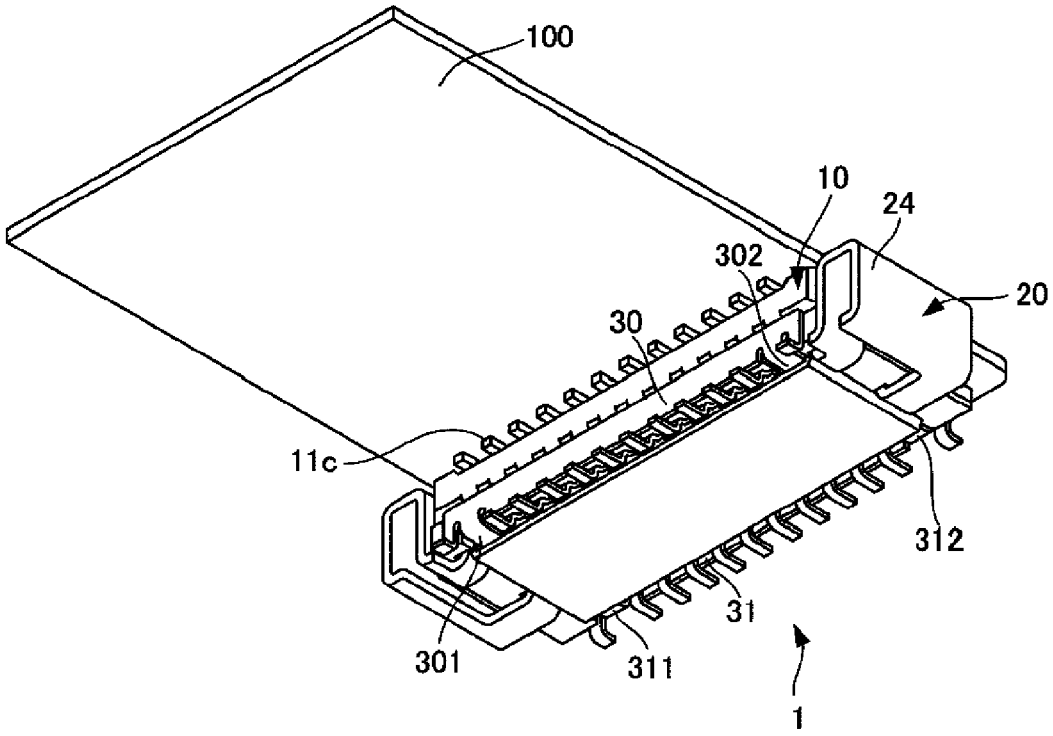
FIG. 1B is a perspective view illustrating the same as viewed from the receptacle side.

FIGS. 1A and 1B are each a perspective view illustrating a connector 1 according to the embodiment of the present invention in which a plug 10 has been fitted into a corresponding receptacle 20.

Contacts 11*c* of the plug 10 are soldered to contacts (not shown) of an FPC (flexible printed circuit) 100 to form a plug assembled body.

The FPC 100 is a board obtained by forming a circuit on a substrate including an insulating thin and flexible base film such as a polyimide film and a conductive metal such as a copper foil adhered to each other. Since a reinforcing plate 13 is provided to the plug 10 as will be described later, it is optional whether to provide a reinforcing plate to the FPC 100.

As will be described later, fitting between the plug 10 and the receptacle 20 is performed by inserting locking parts 12 provided at opposite ends of the reinforcing plate 13 in the plug 10 into spaces inside hold-down parts 24 and 25 of the receptacle 20 and engaging engagement protrusions 245 and 255 of the hold-down parts 24 and 25 with respective recesses 14 in the locking parts 12. The recesses 14 and the engagement protrusions 245 and 255 together form holding parts.

As illustrated in FIG. 1B, shield members 30 and 31 are attached to the receptacle 20 along opposite sides thereof in a depth direction which is the same as the longitudinal direction of the FPC 100. The shield members 30 and 31 are formed by punching and folding a conductive metal plate, for example. The shield members 30 and 31 exert a shielding effect that blocks external and internal noises which can influence communications.

The shield members 30 and 31 have attachment parts 301, 302, 311, and 312, each having the same shape as that of the contacts 22 and 23, at the opposite ends of the receptacle in a width direction which is the same as the width direction of the FPC 100. These attachment parts are fitted into grooves 22*a* provided for contact attachment in the vicinity of the opposite ends of the receptacle 20 in the width direction. The shield members 30 and 31 are thereby fixed to the receptacle 20.

Figure 2:
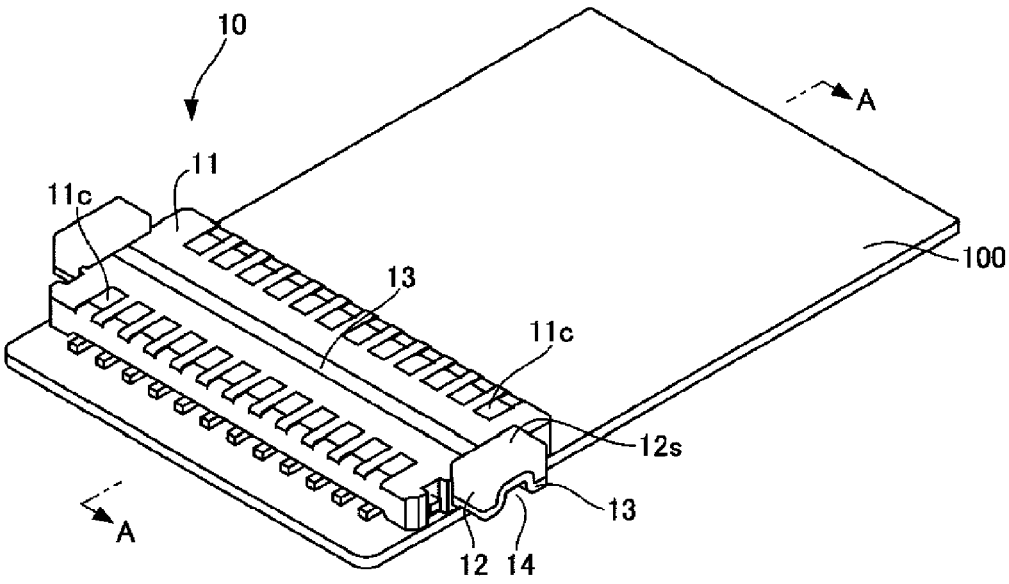
FIG. 2 is a perspective view illustrating the plug assembled body obtained by fixing the plug to an FPC according to the embodiment of the present invention.
Figure 3:
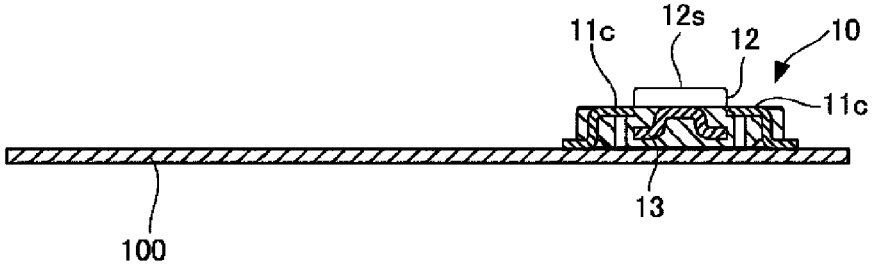
FIG. 3 is a cross-sectional view taken along line A-A of FIG. 2 as viewed in a direction indicated by an arrow.

FIGS. 2 and 3 each illustrate the plug assembled body when the fitting between the plug 10 and the receptacle 20 is released.

The plug 10 includes: a housing 11 (corresponding to a plug housing); the plurality of contacts 11*c* embedded in the housing 11; and the reinforcing plate 13.

The housing 11 is made of a synthetic resin molded in a plate shape and has a depth direction thereof in a longitudinal direction of the FPC 100, a width direction thereof in a width direction of the FPC 100, and a thickness direction thereof in the same direction as a thickness direction of the FPC 100.

The plurality of contacts 11*c* are provided on respective side surfaces of the housing 11 in the depth direction so as to be parallel to each other in the width direction at regular intervals. Each of the contacts 11*c* has: a contact portion exposed from the housing on a visible side in FIG. 2; and a contact portion exposed on the FPC 100 side and soldered to the conductive metal in the FPC 100. The contact portions exposed on the visible side in FIG. 2 come into contact with corresponding contact portions of contacts 22 and 23 in the receptacle 20.

The reinforcing plate 13 is embedded in the width direction at a center of the housing 11 in the depth direction, i.e., between the rows of the contacts 11*c* provided on both the side surfaces thereof. The reinforcing plate 13 is formed from a stainless steel plate in an elongate plate shape, for example.

Figure 4:
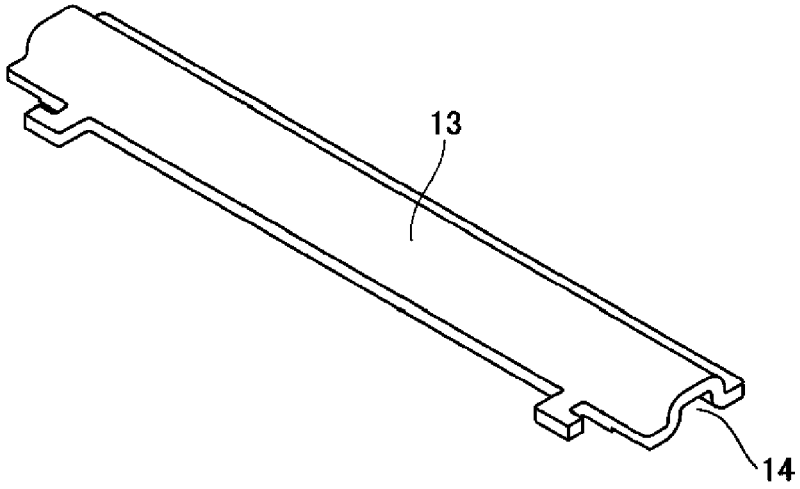
FIG. 4 is a perspective view illustrating an example of a reinforcing plate provided to the plug according to the embodiment of the present invention.

As illustrated in FIG. 4, the reinforcing plate 13 is formed to have a protrusion projecting toward the front side thereof in the width direction in order to enhance the strength thereof. The recess 14 formed by a space along the protrusion is provided on the rear surface side of the reinforcing plate 13.

The shape of the reinforcing plate 13 is not limited to such a shape having a protrusion. As long as a predetermined strength can be obtained, a shape such that a cross-section in the short direction has an L-shape or I-shape may be employed, for example.

Also, the reinforcing plate 13 has a conductive property. Therefore, by functioning as a ground plate, the reinforcing plate 13 can serve to prevent communication failure such as crosstalk when assembled as the connector 1.

As illustrated in FIG. 2, the opposite ends of the reinforcing plate 13 in the longitudinal direction are projected from the opposite ends of the housing 11 in the width direction. The locking parts 12, each having a rectangular shape and made of the synthetic resin same as the material of the housing 11, are provided at the projected portions. Thus, when the plug 10 is fixed to the FPC 100, the locking parts 12 are disposed at positions projected from the opposite ends of the FPC 100 in the width direction as illustrated in FIG. 2.

The locking parts 12 can be integrally molded when the housing 11 is formed. Further, the locking parts 12 are formed in a size capable of being inserted into the spaces inside the hold-down parts 24 and 25 of the receptacle 20.

As illustrated in FIG. 3, the locking part 12 includes: a slide surface 12*s* positioned above a surface of the contact 11*c* at which the contact portion to be in contact with the contact portion of the receptacle 20 (i.e., the contact portion on the upper side in FIG. 3) is exposed; and side surfaces extending toward the FPC 100 from the opposite edges of the slide surface 12*s*. As will be described later, the slide surface 12*s* slides over a guiding surface 212*g* of a guiding part 212 in the receptacle 20. One of the side surfaces of the locking part 12 serves as a reference surface used for positioning when the plug 10 is fitted into the receptacle 20.

Figure 5A:
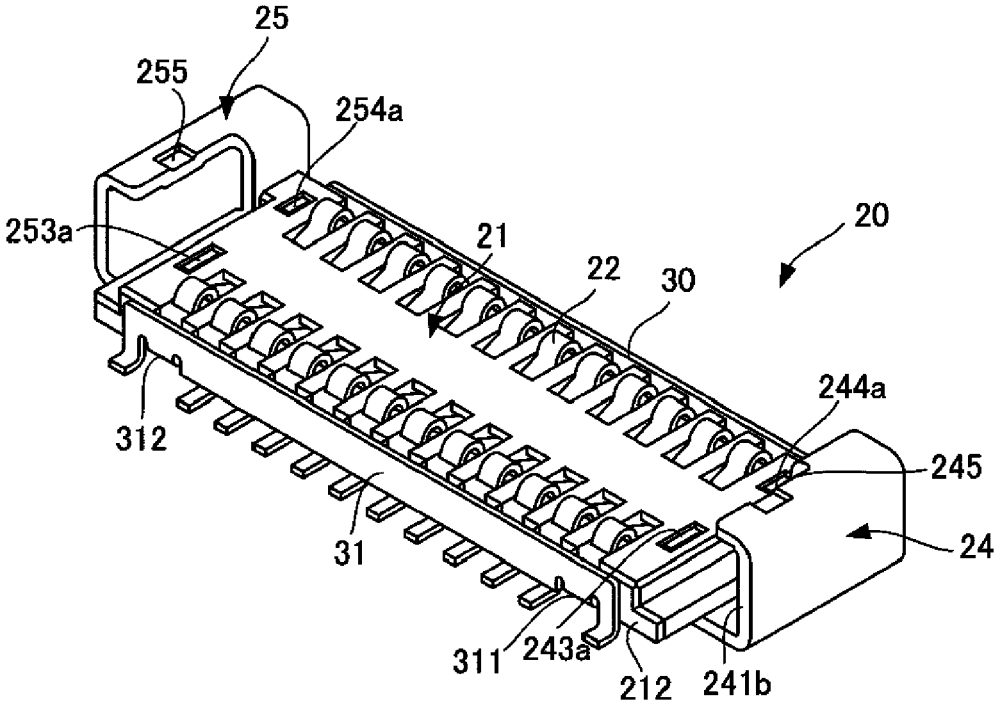
FIG. 5A is a perspective view illustrating the receptacle having a shield structure as viewed from a side where the plug assembled body according to the embodiment of the present invention is to be attached.
Figure 5B:
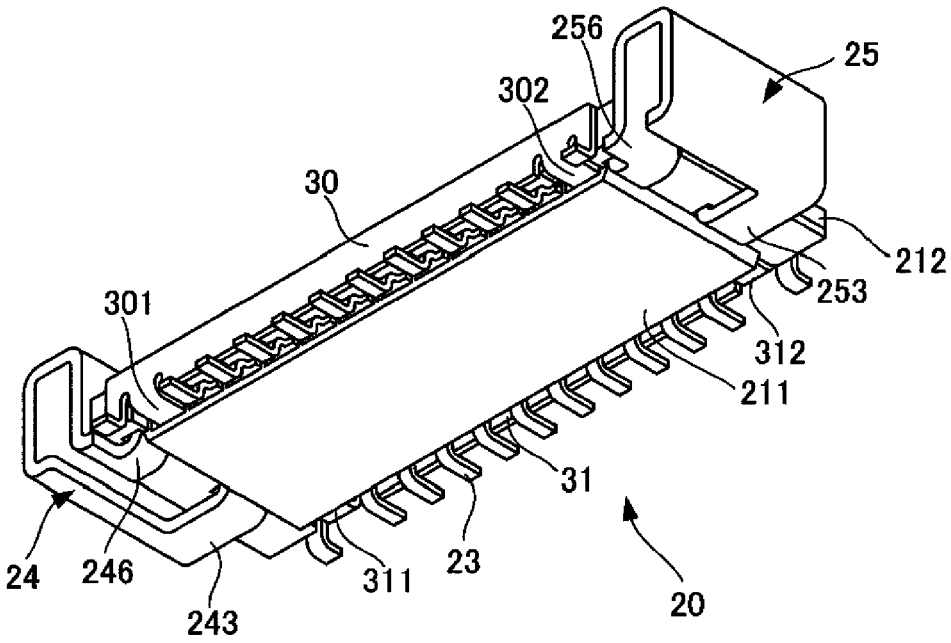
FIG. 5B is a perspective view illustrating the same as viewed from a direction different from that of FIG. 5A.
Figure 6:
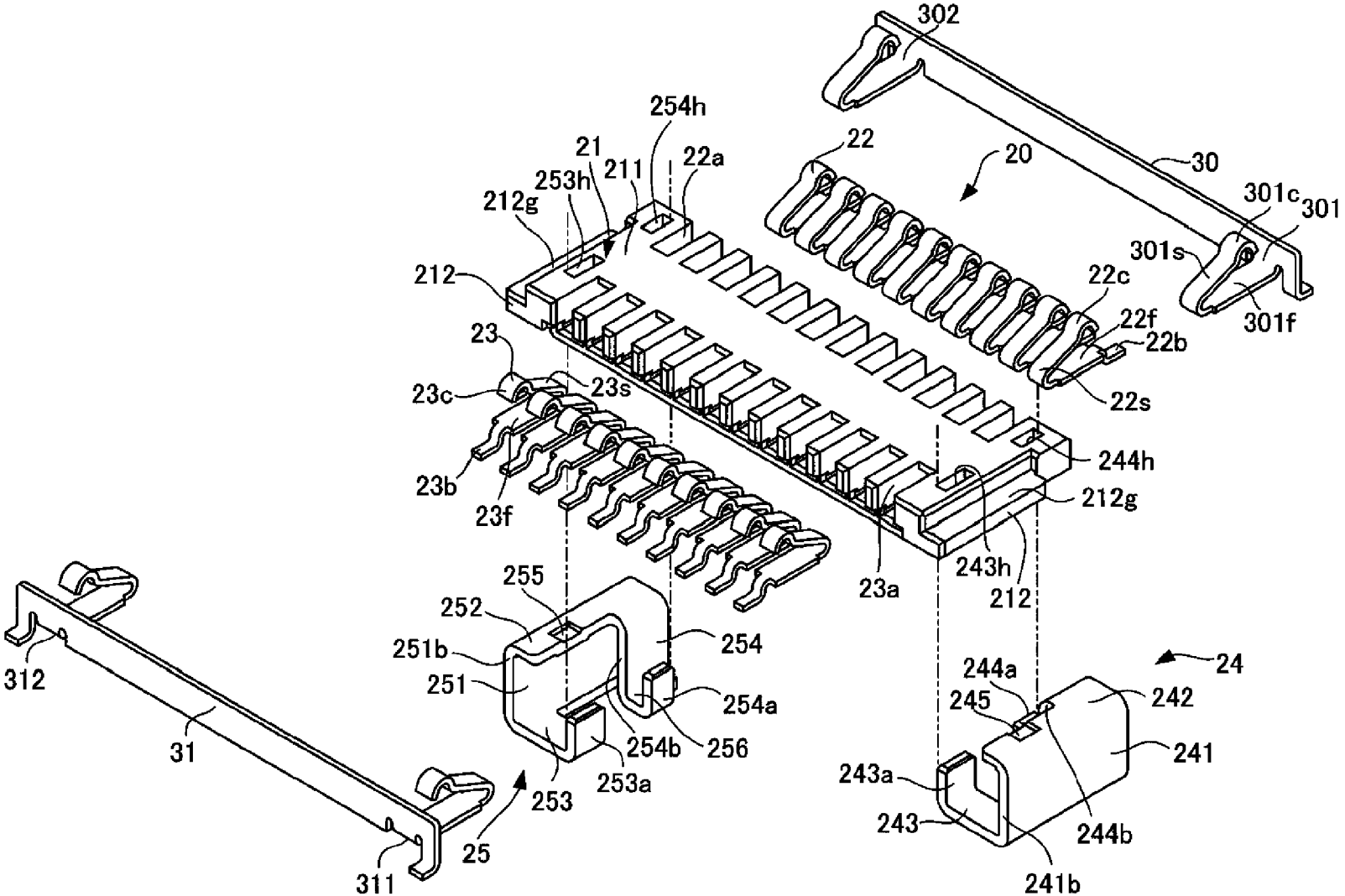
FIG. 6 is an exploded perspective view illustrating the receptacle having the shield structure of FIG. 5A as viewed from the side where the plug assembled body according to the embodiment of the present invention is to be attached.

FIGS. 5A and 5B are perspective views illustrating the receptacle 20 as viewed from directions different from each other. FIG. 6 is an exploded perspective view of the receptacle 20. With reference to these figures, a configuration of the receptacle 20 will be described in detail.

The receptacle 20 includes: a housing 21 (corresponding to the receptacle housing); the contacts 22 and 23; and the hold-down parts 24 and 25.

The housing 21 is in the form of a frame made of a synthetic resin such as an LCP (Liquid Crystal Polymer). The housing 21 is formed in a plate shape having a width direction, a depth direction, and a thickness direction. The housing 21 includes: a contact attachment part 211; and the guiding parts 212 for guiding the locking parts 12 of the plug 10 when the contacts are fitted.

The width direction, the depth direction, and the thickness direction of the housing 21 of the receptacle 20 coincide with those of the housing 11 of the plug 10, respectively, when the plug 10 is fitted into the receptacle 20.

The contact attachment part 211 includes a plurality of grooves 22*a* formed on the respective side surfaces thereof in the depth direction so as to be parallel to each other in the width direction at regular intervals. A single contact 22 or 23 is attached to each of the grooves 22*a*. The number and positions of the contacts 22 and 23 correspond to those of the contacts 11*c* in the plug 10.

According to this embodiment, however, the grooves 22*a* positioned at the opposite ends of the housing 21 in the longitudinal direction are used for fixing the shield members 30 and 31 to be described later and no contacts 22 and 23 are attached to those grooves 22*a* positioned at the opposite ends of the housing 21 in the longitudinal direction. Therefore, the number and positions of the contacts 11*c* of the plug 10 are determined also in consideration of the number and positions of the grooves 22*a* used for fixing the shield members 30 and 31.

The contacts 22 and 23 comprise: curved contact portions 22*c* and 23*c* to be in contact with the contact portions of the contacts 11*c* in the plug 10; contact portions 22*b* and 23*b* to be connected to contacts of a substrate (not shown); fixed portions 22*f* and 23*f* to be fixed in the grooves 22*a* of the contact attachment part 211; and elastic deformable portions 22*s* and 23*s* positioned between the fixed portions and the curved contact portions, respectively.

The shield members 30 and 31 are attached so as to cover the contact rows disposed at the side surfaces of the receptacle 20, respectively.

The shield members 30 and 31 are provided with the attachment parts 301, 302, 311, and 312. The attachment parts 301, 302, 311, and 312 include: contact portions 301*c*, 302*c*, 311*c*, and 312*c*; fixed portions 301*f*, 302*f*, 311*f*, and 312*f*; and elastic deformable portions 301*s*, 302*s*, 311*s*, and 312*s*, respectively.

The contact portions 301*c*, 302*c*, 311*c*, and 312*c*, the fixed portions 301*f*, 302*f*, 311*f*, and 312*f*, and the elastic deformable portions 301*s*, 302*s*, 311*s*, and 312*s* are all configured to be inserted into the grooves 22*a* having the same shape. Thus, they have shapes similar to those of the contact portions 22*c* and 23*c*, the fixed portions 22*f* and 23*f*, and the elastic deformable portions 22*s* and 23*s* of the contacts 22 and 23, respectively.

The shield members 30 and 31 are fixed to the receptacle 20 by inserting the attachment parts 301, 302, 311, and 312 into the corresponding grooves 22*a* positioned at the opposite ends of the housing 21 in the longitudinal direction and fitting the fixed portions 301*f*, 302*f*, 311*f*, and 312*f* into those grooves.

The contact portions 301*c*, 302*c*, 311*c*, and 312*c* of the shield members 30 and 31 are in contact with contact portions of the substrate provided for ground connection. Consequently, the shield members 30 and 31 are connected to the ground, thereby producing the shielding effect.

Through holes 243*h*, 244*h*, 253*h*, and 254*h* used for the attachment of the hold-down parts 24 and 25 are formed at the opposite ends of the contact attachment part 211 in the width direction and in the vicinity of the guiding parts 212. Attachment portions 243*a*, 244*a*, 253*a*, and 254*a* of the hold-down parts 24 and 25 are inserted into and fixed to these through holes.

The hold-down parts 24 and 25 have a mirror-image relationship when they face each other, i.e., have a symmetrical shape about a plane provided therebetween.

The hold-down parts 24 and 25 each are made of a copper alloy material, for example, and formed in a shape of a hollow generally rectangular column. More specifically, the hold-down parts 24 and 25 include: main body walls 241 and 251 disposed in a direction perpendicular to the plane of the contact attachment part 211; and pushed walls 242 and 252 extending from upper ends (as viewed in FIG. 6) of the main body walls 241 and 251 in directions facing each other so as to be parallel to the plane of the contact attachment part 211, respectively.

Furthermore, fixed walls 243 and 253 extend from lower ends (as viewed in FIG. 6) of the main body walls 241 and 251 in directions facing each other so as to be parallel to the plane of the contact attachment part 211, respectively. Also, leg portions 243*a* and 253*a* extend upwardly from ends of the fixed walls 243 and 253, respectively.

Also, stopping walls 244 and 254 extend downwardly from opposing end faces of the pushed walls 242 and 252 so as to be parallel to the main body walls 241 and 251, respectively. Fixed walls 246 and 256 extend from lower ends of the stopping walls 244 and 254, respectively, in directions facing each other so as to be parallel to the plane of the contact attachment part 211. Leg portions 244*a* and 254*a* extend upwardly from ends of the fixed walls 246 and 256, respectively.

The leg portions 243*a* and 244*a* of the hold-down part 24 are inserted into and fixed to the through holes 243*h* and 244*h* of the contact attachment part 211, respectively. Also, the leg portions 253*a* and 254*a* of the hold-down part 25 are inserted into and fixed to the through holes 253*h* and 254*h* of the contact attachment part 211, respectively.

The engagement protrusions 245 and 255, projecting toward the side of the fixed walls 246 and 256, are formed on the pushed walls 242 and 252. The engagement protrusions 245 and 255 can be formed by press work, for example. The pushed walls 242 and 252 can be deformed and has elasticity. Therefore, the engagement protrusions 245 and 255 can return to their original positions after a force lifting the engagement protrusions 245 and 255 outwardly is applied thereto and then removed therefrom.

Internal spaces of the hold-down parts 24 and 25 are defined by the confining walls, such as 241, 242, and 243, forming the hold-down parts 24 and 25 and the guiding surfaces 212*g* of the guiding parts 212, respectively.

When fitting the plug 10 into the receptacle 20, the engagement protrusions 245 and 255 each can climb over a portion of the reinforcing plate 13 in the locking part 12 and fit into the recess 14. This allows the plug 10 to be fitted into the receptacle 20 in the right position.

Continuous end faces of the pushed walls 242 and 252, the main body walls 241 and 251, the fixed walls 243 and 253, and the leg portions 243*a* and 253*a* form reference surfaces 241*b* and 251*b* used for aligning the plug 10 with the receptacle 20 upon the fitting therebetween, respectively.

The reference surfaces 241*b* and 251*b* and the guiding parts 212 together form insertion openings through which the locking parts 12 of the plug 10 are to be inserted. The insertion openings are in communication with the internal spaces of the hold-down parts 24 and 25 in the depth direction of the housing 21.

End faces of the stopping walls 244 and 254 on the side of the insertion openings form stopping parts 244*b* and 254*b*, respectively. When the plug 10 is fitted into the receptacle 20, these stopping parts serve to stop the locking parts 12 of the plug 10 at predetermined positions so that the locking parts 12 do not move beyond the proper fitting positions.

In FIG. 5A, the lower surfaces of the fixed walls 243, 253, 246, and 256 in the hold-down parts 24 and 25 are fixed to the substrate (not shown) by means of reflow soldering or the like. As a result, the receptacle 20 is fixed to the substrate.

Procedures when the plug 10 and the receptacle 20 are slid over each other for fitting therebetween in the depth directions of the respective housings thereof according to the embodiment of the present invention will now be described with reference to FIGS. 7 to 9. Although only one locking part 12 in the plug 10 and only one hold-down part 24 in the receptacle 20 positioned on one side are shown in these figures, the same procedures as those shown in these figures are applied also to the other locking part 12 in the plug 10 and the hold-down part 25 in the receptacle 20 positioned on the other side.

First of all, the width direction of the plug 10 in the plug assembled body is generally aligned with that of the receptacle 20. Then, the plug 10 in the plug assembled body is faced to and moved toward the receptacle 20, and they are held so as to be slightly displaced from each other and to be parallel to each other. As illustrated in FIG. 7, as the plug 10 is brought closer to the receptacle 20, they are disposed in such a manner that one side surfaces (the right side surface in FIG. 7) of the locking parts 12 of the plug 10 are positioned parallel to and close to the reference surfaces 241*b* and 251*b* of the hold-down parts 24 and 25 in the receptacle 20, respectively. It is thereby possible to reliably perform positioning between the locking parts 12 of the plug 10 and the hold-down parts 24 and 25 of the receptacle 20 upon fitting.

Figure 7:
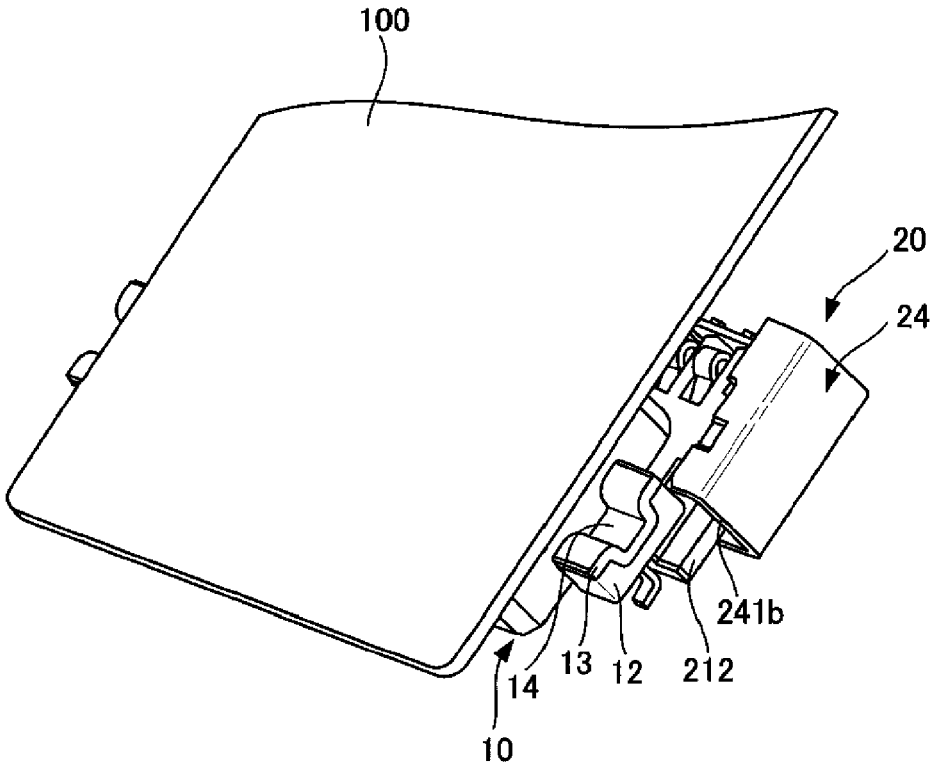
FIG. 7 is a partial enlarged perspective view used for explaining a procedure for fitting the plug into the receptacle according to the embodiment of the present invention, illustrating a state when alignment between the plug and the receptacle is being performed.

According to the state shown in FIG. 7, the plane of the plug 10 and that of the receptacle 20 are faced each other and the curved contact portions 22*c* and 23*c* of the contacts 22 and 23 in the receptacle 20 are in contact with the flat surface of the plug 10 facing the receptacle 20. However, the curved contact portions 22*c* and 23*c* of the contacts 22 and 23 are not in contact with the contacts 11*c* of the plug 10 in a proper manner.

Figure 8:
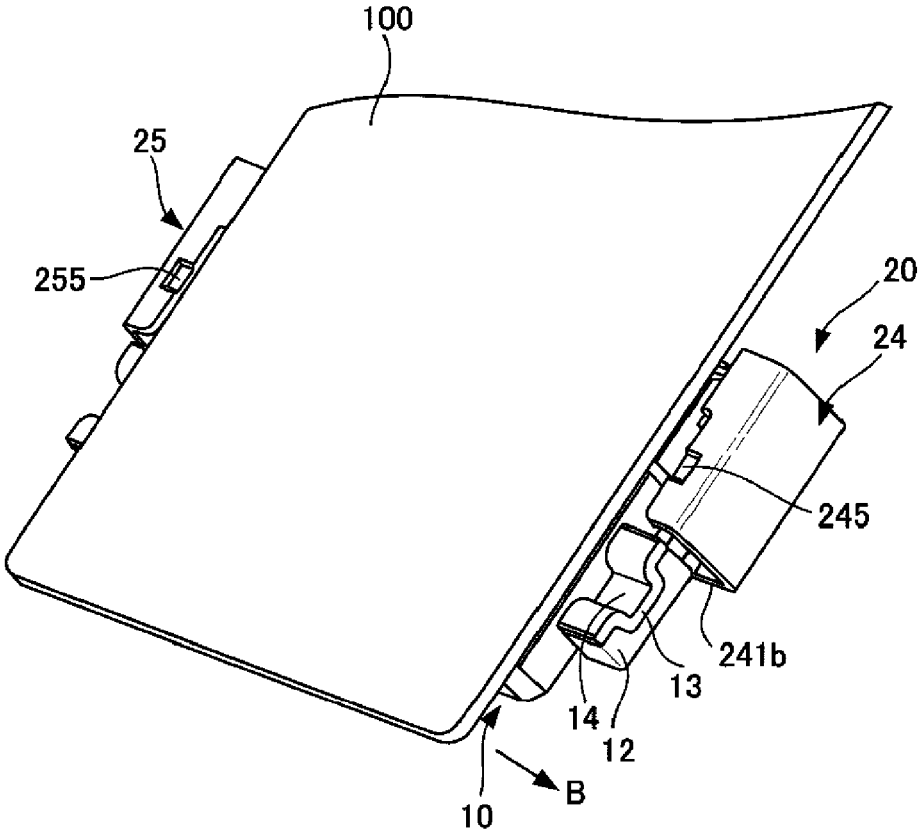
FIG. 8 is a partial enlarged perspective view used for explaining a procedure for fitting the plug into the receptacle according to the embodiment of the present invention, illustrating a state when the plug is being pushed against the receptacle.

Next, the FPC 100 in the plug assembled body is pushed toward the receptacle 20 as indicated by an arrow B in FIG. 8. The curved contact portions 22*c* and 23*c* of the contacts 22 and 23 in the receptacle 20 are thereby pressed toward the grooves 22*a* by the flat surface of the plug 10 facing the receptacle 20. The elastic deformable portions 22*s* and 23*s* of the contacts 22 and 23 in the receptacle 20 are thereby deformed, resulting in a configuration such that the locking parts 12 are faced to the insertion openings of the hold-down parts 24 and 25 as illustrated in FIG. 8. In this state, the slide surfaces 12*s* of the locking parts 12 in the plug 10 are on the guiding surfaces 212*g* of the guiding parts 212 in the receptacle 20.

Figure 9:
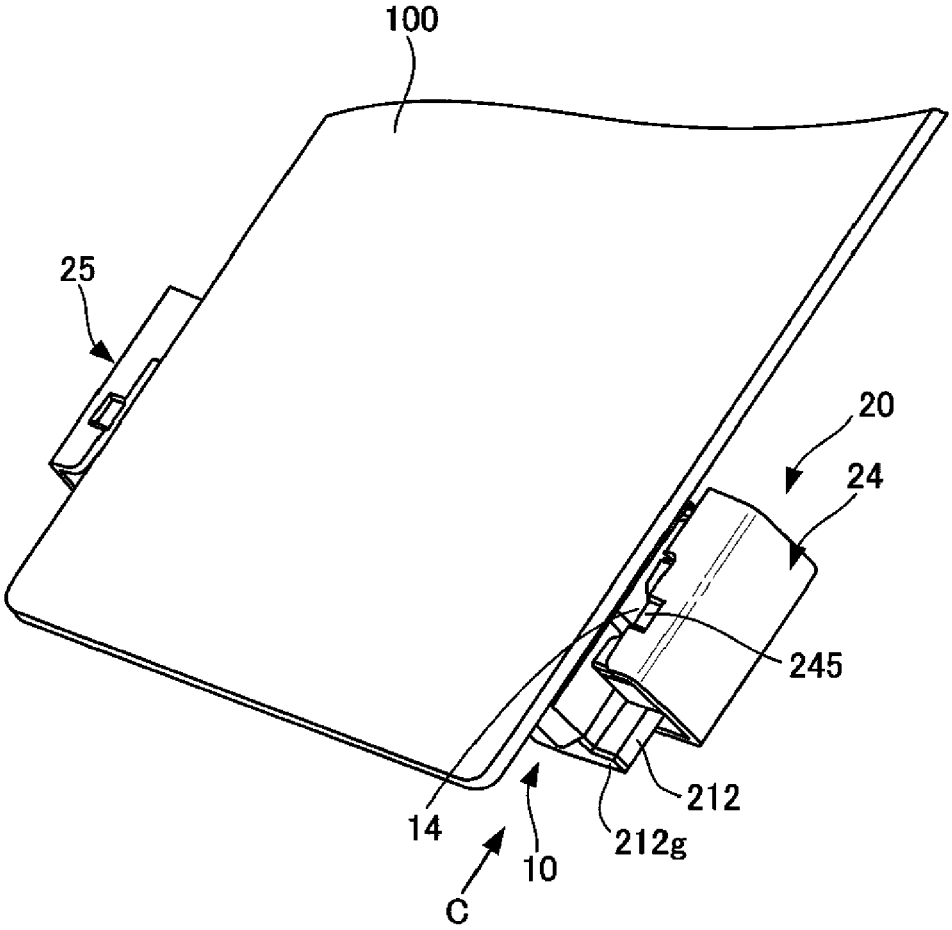
FIG. 9 is a partial enlarged perspective view used for explaining a procedure for fitting the plug into the receptacle according to the embodiment of the present invention, illustrating a state when the plug has been slid over the receptacle to complete the fitting therebetween.

Next, while pressing the plug assembled body against the receptacle 20, the slide surfaces 12*s* of the locking parts 12 are slid over the guiding surfaces 212*g* of the guiding parts 212 in the receptacle 20 as indicated by an arrow C in FIG. 9 so as to insert the locking parts 12 into the internal spaces of the hold-down parts 24 and 25 through the insertion openings thereof. The inner face (the face perpendicular to the width direction of the housing 11) of the locking part 12 is then being guided by the inner face (the face perpendicular to the width direction of the housing 21) of the guiding part 212 in the receptacle 20.

When the locking parts 12 are inserted into the respective internal spaces of the hold-down parts 24 and 25 through the insertion openings thereof, on the other hand, the engagement protrusions 245 and 255 in the pushed walls 242 and 252 of the hold-down parts 24 and 25 each abut against a side end of the reinforcing plate 13 in the short direction in the locking part 12.

When the locking parts 12 are further pressed into the internal spaces of the hold-down parts 24 and 25, the engagement protrusions 245 and 255 each ride on the side end of the reinforcing plate 13 in the short direction in the locking part 12 and further proceed to be fitted into the recess 14.

This allows the engagement protrusions 245 and 255 to return to their original positions. This is because the pushed walls 242 and 252 at which the engagement protrusions 245 and 255 are formed can be deformed and has elasticity.

In order to release the fitting between the plug 10 and the receptacle 20, the plug assembled body is slid relative to the receptacle 20 in a direction along the plane of the FPC 100 so as to pull out the locking parts 12 from the insides of the hold-down parts 24 and 25.

Each of the engagement protrusions 245 and 255 is then being pushed up outwardly as it moves along a curved surface of the reinforcing plate 13 from the recess 14. Each of the engagement protrusions 245 and 255 eventually climbs over the end of the reinforcing plate 13, thereby being removed from the locking part 12. Due to the elasticity of the pushed walls 242 and 252, the engagement protrusions 245 and 255 return to their original positions. At this point, fitting between the plug 10 and the receptacle 20 is substantially released.

A procedure for checking if fitting between the plug 10 and the receptacle 20 is appropriate or not will now be described below with reference to FIGS. 10A and 10B.

Figure 10A:
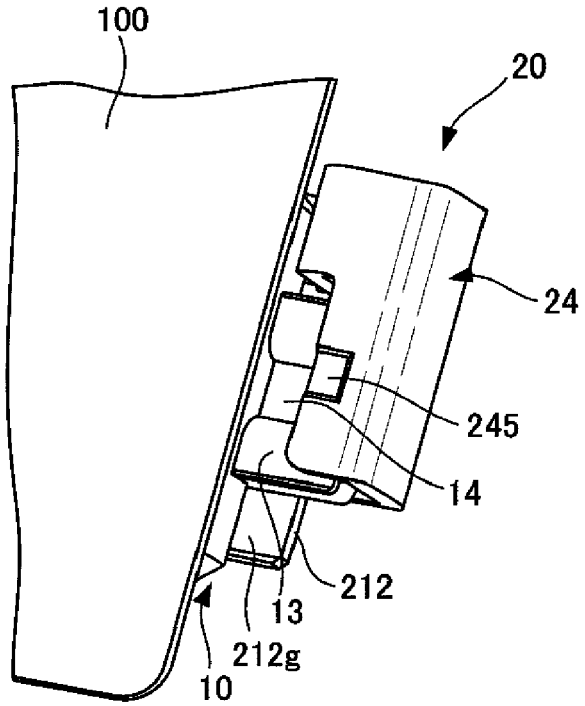
FIG. 10A is a partial enlarged perspective view used for explaining a procedure for checking a fitting state between the plug and the receptacle according to the embodiment of the present invention, illustrating an imperfect fitting state.

In FIG. 10A, one can visually confirm that the position of the engagement protrusion 245 in the hold-down part 24 of the receptacle 20 is displaced from that of the recess 14 in the locking part 12 of the plug 10. This indicates that the engagement protrusion 245 has not been appropriately fitted into the recess 14, thereby failing to return to its original position. Thus, the fitting has not been completed yet in such a state.

Figure 10B:
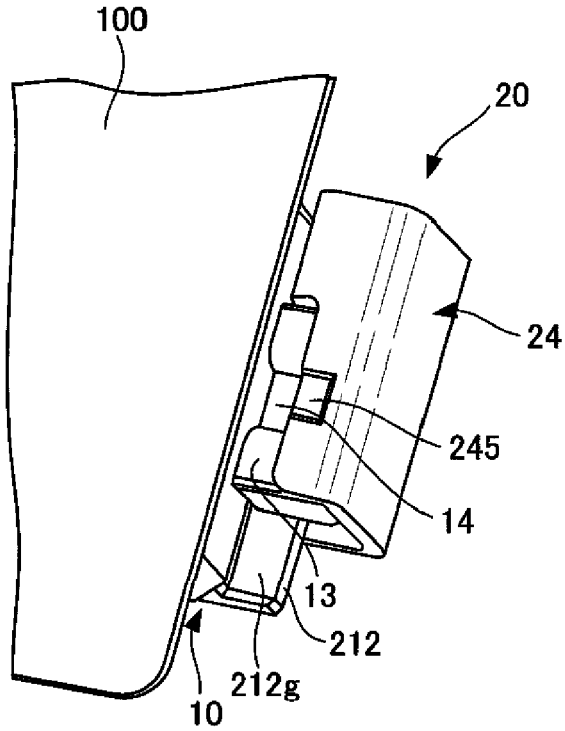
FIG. 10B is a partial enlarged perspective view used for explaining the procedure for checking a fitting state between the plug and the receptacle according to the embodiment of the present invention, showing a normal fitting state.

In FIG. 10B, one can visually confirm that the engagement protrusion 245 in the hold-down part 24 of the receptacle 20 has been completely fitted into the recess 14 in the locking part 12 of the plug 10. This is a state indicating that the engagement protrusion 245 has been appropriately fitted into the recess 14 and has returned to its original position. Such a state represents normal fitting.

According to the embodiment described above, the shield members 30 and 31 is attached by utilizing part of the grooves 22*a* into which the contacts of the receptacle 20 are to be inserted. Also, the lengths of the shield members 30 and 31 in the longitudinal direction fall within the length of the housing 21 in the width direction and the lengths of the shield members 30 and 31 in the short direction fall within the length of the housing 21 in the thickness direction. It is therefore possible to achieve a height reduction in the connector.

According to the embodiment described above, the shield members 30 and 31 disposed on the respective side surfaces of the receptacle 20 cover the contacts disposed at the side surfaces of the receptacle 20, respectively. Instead, the contacts may be divided into groups each including four or six contacts and each group may be covered by a shield member. In this case, the grooves 22*a* positioned adjacent to the opposite ends of the group of four or six contacts are used for inserting and fixing the attachment parts 301, 302, 311, and 312 of the shield members 30 and 31, and ground connection is achieved by these attachment parts.

According to the embodiment described above, the engagement protrusions 245 and 255 are provided in the respective hold-down parts 24 and 25 of the receptacle 20; the recesses 14 are formed in the locking parts 12 of the plug 10; and the engagement protrusions 245 and 255 are configured to be fitted into the recesses 14. Instead, engagement protrusions may be formed in the locking parts 12 and recesses into which the engagement protrusions of the locking parts 12 are to be fitted may be formed in the pushed walls 242 and 252 of the hold-down parts 24 and 25, for example. In this case, the locking parts 12 may have elasticity allowing the engagement protrusions to protrude or recede. Alternatively, portions of the pushed walls 242 and 252 may have a property capable of being elastically deformed and recesses into which engagement protrusions can be fitted may be formed in those portions.

Moreover, according to the embodiment described above, fitting between the plug 10 and the receptacle 20 can be checked by the engagement protrusions 245 and 255 in the hold-down parts 24 and 25 of the receptacle 20 being fitted into the recesses 14 in the locking parts 12 of the plug 10. Instead, without forming the engagement protrusions 245 and 255 in the hold-down parts 24 and 25 and without forming the recesses 14 in the locking parts 12, it is also possible to conclude that fitting has been completed when the side surfaces of the locking parts 12 serving as the reference surfaces abut against the stopping parts 244*b* and 254*b* formed on the end faces of the stopping walls 244 and 254 in the hold-down parts 24 and 25 on the side of the insertion openings. In this case, the stopping parts 244*b* and 254*b* function as holding parts.

In such a configuration, the surface of the locking part 12 of the plug 10 at which the reinforcing plate 13 is provided is pressed against the inner surface of each of the pushed walls 242 and 252 of the hold-down parts 24 and 25 due to the elastic force of the contacts 22 and 23 in the receptacle 20. Due to the frictional force generated at that position, fitting between the plug 10 and receptacle 20 cannot be easily released even without the engagement between the engagement protrusion and the recess.

Note that the technical scope of the connector according to the present invention is not limited to the embodiments described above. It includes various variations and modifications without departing from the scope of the present invention.

REFERENCE SIGNS LIST

1 Connector
10 Plug
11, 21 Housing (plug housing, receptacle housing)
11*c*, 22, 23 Contact
12 Locking part
12*s* Slide surface
13 Reinforcing plate
14 Recess
20 Receptacle
24, 25 Hold-down part
30, 31 Shield member
100 FPC
212 Guiding part
212*g* Guiding surface
242 Pushing wall
245 Engagement protrusion
301, 302, 311, 312 Attachment part

The invention claimed is:

1. A connector comprising a receptacle and a plug,
the receptacle including:
a receptacle housing of a plate shape having a width direction, a depth direction, and a thickness direction;
a plurality of contacts disposed on respective side surfaces of the receptacle housing in the depth direction so as to be parallel to each other in the width direction; and
a conductive shield member having an attachment part, wherein
the receptacle housing is provided with a plurality of grooves having the same shape into which the plurality of contacts and the attachment part can be inserted, and
the plug including:
a plug housing of a plate shape having a width direction, a depth direction, and a thickness direction;
contacts disposed on respective side surfaces of the plug housing in the depth direction so as to be parallel to each other in the width direction; and
locking parts provided at positions projected from opposite side surfaces of the plug housing in the width direction, wherein
the connector further comprises hold-down parts provided at positions projected from respective side surfaces of the receptacle housing in the width direction, each of the hold-down parts having: an insertion opening and an internal space into which the locking part of the plug can be inserted in the depth direction; and a holding part for holding the locking part at a predetermined position, the insertion opening being in communication with the internal space in the depth direction of the housing.

2. The connector according to claim 1, wherein
the shield member has a plate shape extending in the width direction,
the attachment part is one of a plurality of attachment parts that the shield member has, the plurality of attachment parts including at least one attachment part for each end of the shield member in the width direction, and
each of the attachment parts can be inserted into one of the plurality of grooves of the receptacle housing.

3. The connector according to claim 1, wherein the plug further includes a reinforcing plate formed in an elongate plate shape and disposed in the width direction at a center of the plug housing in the depth direction.

4. The connector according to claim 3, wherein the reinforcing plate is conductive.

5. The connector according to claim 1, wherein each of the contacts in the receptacle includes: a contact portion to be in contact with a corresponding one of the contacts in the plug, an elastic deformable portion, and a fixed portion, and the attachment part of the shield member includes a contact portion, an elastic deformable portion, and a fixed portion having respective shapes similar to those of the contact.

* * * * *